US010218134B2

(12) United States Patent
Tsai et al.

(10) Patent No.: US 10,218,134 B2
(45) Date of Patent: Feb. 26, 2019

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Long-Fei Chen, New Taipei (TW); Hsu-Fen Wang, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/702,148

(22) Filed: Sep. 12, 2017

(65) Prior Publication Data

US 2018/0076581 A1 Mar. 15, 2018

(30) Foreign Application Priority Data

Sep. 14, 2016 (CN) ..... 2016 2 1055762 U

(51) Int. Cl.
*H01R 13/6585* (2011.01)
*H01R 24/60* (2011.01)
*H01R 107/00* (2006.01)

(52) U.S. Cl.
CPC ..... *H01R 24/60* (2013.01); *H01R 13/6585* (2013.01); *H01R 2107/00* (2013.01)

(58) Field of Classification Search
CPC ..... H01R 13/6585
USPC ..... 439/607.11, 607.09
See application file for complete search history.

(56) References Cited

U.S. PATENT DOCUMENTS 6,074,225 A * 6/2000 Wu ..... H01R 13/6582 439/101
7,758,379 B2 * 7/2010 Chen ..... H01R 13/6485 439/607.11
8,025,532 B2 * 9/2011 Nagata ..... H01R 13/506 439/607.4
8,262,411 B2 * 9/2012 Kondo ..... H01R 13/6658 439/607.01
8,475,216 B2 * 7/2013 Tung ..... H01R 13/506 439/607.4
8,506,317 B2 * 8/2013 Lim ..... H01R 9/032 439/345

(Continued)

*Primary Examiner* — Neil Abrams
(74) *Attorney, Agent, or Firm* — Muncy, Geissler, Olds & Lowe, P.C.

(57) ABSTRACT

An electrical receptacle connector includes a metallic shell, an insulated housing, first receptacle terminals, second receptacle terminals, a shielding plate, and a terminal organizer. The insulated housing is in the receptacle cavity of the metallic shell. The first receptacle terminals are assembled with the insulated housing. The second receptacle terminals are assembled with the terminal organizer. The insulated housing and the terminal organizer are assembled with each other. The shielding plate is between the first receptacle terminals and the second receptacle terminals. The terminal organizer extends the fixation portion attaching to the front portions of the second receptacle terminals, so that the front portions of the second receptacle terminals are securely held on the tongue portion. Therefore, when the terminal organizer is deformed due to heating, the front portions of the second receptacle terminals can be still fixed on the tongue portion without being deflected upwardly.

14 Claims, 10 Drawing Sheets

(56) References Cited

U.S. PATENT DOCUMENTS 8,851,927 B2 * 10/2014 Hsu ..... H01R 12/724 439/607.11
8,968,031 B2 * 3/2015 Simmel ..... H01R 13/659 439/660
9,178,319 B2 * 11/2015 Little ..... H01R 13/6585
9,214,766 B1 * 12/2015 Yu ..... H01R 13/6585
9,281,643 B1 * 3/2016 Tseng ..... H01R 13/518
9,300,095 B2 * 3/2016 Lin ..... H01R 24/60
9,312,641 B2 * 4/2016 Wang ..... H01R 13/6585
9,318,856 B2 * 4/2016 MacDougall ..... H01R 13/6581
9,356,404 B2 * 5/2016 Yu ..... H01R 13/6594
9,379,494 B1 * 6/2016 Hu ..... H01R 13/6594
9,379,499 B2 * 6/2016 Miyoshi ..... H01R 24/60
9,437,980 B2 * 9/2016 Ueda ..... H01R 13/6596
9,444,199 B2 * 9/2016 Leng ..... H01R 13/6596
9,484,679 B2 * 11/2016 Guo ..... H01R 13/6585
9,496,657 B1 * 11/2016 Chang ..... H01R 13/6471
9,496,664 B2 * 11/2016 Little ..... H01R 13/6587
9,502,821 B2 * 11/2016 Little ..... H01R 13/6582
9,515,405 B2 * 12/2016 Zhao ..... H01R 13/405
9,525,243 B1 * 12/2016 Yuan ..... H01R 13/6585
9,525,244 B1 * 12/2016 Hsu ..... H01R 13/6585
9,614,310 B2 * 4/2017 Tsai ..... H01R 12/724
9,627,817 B2 * 4/2017 Chang ..... H01R 13/6594
9,647,369 B2 * 5/2017 Tsai ..... H01R 4/02
9,647,393 B2 * 5/2017 Tsai ..... H01R 13/6581
9,667,001 B2 * 5/2017 Zhao ..... H01R 13/6581
9,673,569 B2 * 6/2017 Zhang ..... H01R 13/6585
9,680,260 B2 * 6/2017 Fan ..... H01R 13/6585
9,685,739 B2 * 6/2017 Chen ..... H01R 13/6585
9,711,910 B2 * 7/2017 Zhao ..... H01R 13/6581
9,722,369 B1 * 8/2017 Hsu ..... H01R 24/60
9,728,885 B2 * 8/2017 Yokoyama ..... H01R 13/502
9,728,899 B2 * 8/2017 Peng ..... H01R 13/6581
9,742,121 B2 * 8/2017 Hayashi ..... H01R 13/6585
9,780,468 B2 * 10/2017 Yokoyama ..... H01R 12/7047
9,780,497 B1 * 10/2017 Jeon ..... H01R 13/659
9,831,615 B2 * 11/2017 Saito ..... H01R 13/6596
9,837,769 B2 * 12/2017 Yu ..... H01R 12/716
9,837,772 B2 * 12/2017 Tsai ..... H01R 13/502
9,859,661 B2 * 1/2018 Park ..... H01R 13/6585
9,871,327 B2 * 1/2018 Simmel ..... H01R 13/6597
9,876,318 B2 * 1/2018 Gao ..... H01R 13/6582
9,887,472 B2 * 2/2018 Park ..... H01R 12/7076
9,893,473 B2 * 2/2018 Kong ..... H01R 13/6594
9,905,944 B2 * 2/2018 Little ..... H01R 13/6658
9,912,086 B2 * 3/2018 Guo ..... H01R 12/716
9,912,106 B2 * 3/2018 Yao ..... H01R 13/6594
9,912,111 B2 * 3/2018 Little ..... H01R 24/60
9,917,405 B2 * 3/2018 Ju ..... H01R 13/6585
9,923,286 B2 * 3/2018 Cheng ..... H01R 9/032
9,923,310 B2 * 3/2018 Kao ..... H01R 13/6596
9,923,317 B2 * 3/2018 Yao ..... H01R 24/62
9,960,552 B2 * 5/2018 Tsai ..... H01R 24/64
10,008,793 B2 * 6/2018 Ju ..... H01R 24/78
10,084,245 B2 * 9/2018 Chang ..... H01R 13/6586
2015/0295362 A1 * 10/2015 Tziviskos ..... H01R 13/6581 439/607.01
2016/0020569 A1 * 1/2016 Ju ..... H01R 24/78 439/607.01
2016/0064869 A1 * 3/2016 Yu ..... H01R 24/60 439/607.05
2016/0294121 A1 * 10/2016 Daughtry, Jr. ..... H01R 13/405
2016/0380389 A1 * 12/2016 Ju ..... H01R 13/6585 439/607.05
2017/0310058 A1 * 10/2017 Ju ..... H01R 13/6585
2018/0076581 A1 * 3/2018 Tsai ..... H01R 24/60
2018/0097298 A1 * 4/2018 Ju ..... H01R 13/04

* cited by examiner

ELECTRICAL RECEPTACLE CONNECTOR

CROSS-REFERENCE TO RELATED APPLICATION

This non-provisional application claims priority under 35 U.S.C. § 119(a) to Patent Application No. 201621055762.2 filed in China, P.R.C. on Sep. 14, 2016, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0 or USB 3.1, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes receptacle terminals, a plastic core, and a tongue portion at the front portion of the plastic core. Further, the conventional USB type-C electrical receptacle connector further includes an outer iron shell circularly enclosing the plastic core.

SUMMARY OF THE INVENTION

For different fabrication requirements, a conventional electrical receptacle connector has a plastic core in at least two or more parts. The two or more parts of the plastic core are respectively formed with upper and lower receptacle terminals followed by assembling the parts together. Hence, the efficiency for fabrication can be enhanced. However, after the plastic core is formed with the receptacle terminals, the flat contact portions of the receptacle terminals are not held in the plastic core. In other words, the flat contact portions (front portions) of the receptacle terminals are not supported by the plastic core; instead, the flat contact portions are suspended. As a result, during the manufacturing process of the electrical receptacle connector, when the electrical receptacle connector is heated (e.g., when the circuit board is heated in the flow convention oven), the plastic core would deform and the flat contact portions of the receptacle terminals are deflected upwardly from the tongue portion. Hence, the flat contact portions of the receptacle terminals cannot be steadily attached on the tongue portion. Thus, when the electrical receptacle connector is mated with an electrical plug connector, the flat contact portions of the receptacle terminals of the electrical receptacle connector may not be in contact with the plug terminals in a proper manner. Moreover, the flat contact portions of the receptacle terminals of the electrical receptacle connector may be broken during the operation. Therefore, how to solve the aforementioned problem is an issue.

In view of this, an embodiment of the instant disclosure provides an electrical receptacle connector. The electrical receptacle connector comprises a metallic shell, an insulated housing, a plurality of first receptacle terminals, a plurality of second receptacle terminals, a shielding plate, and at least one terminal organizer. The metallic shell comprises a receptacle cavity. The insulated housing is in the receptacle cavity. The insulated housing comprises a base portion and a tongue portion extending from one end of the base portion. The base portion has an assembling region, and a lower surface of the tongue portion has an engaging groove. The first receptacle terminals are held in the base portion and the tongue portion. Each of the first receptacle terminals comprises a first flat contact portion and a first body portion, the first body portion is held in the base portion and the tongue portion, and the first flat contact portion extends forwardly from the first body portion in a front-to-rear direction and is partly exposed upon the upper surface of the tongue portion. Each of the second receptacle terminals comprises a second flat contact portion and a second body portion, and the second flat contact portion extends forwardly from the second body portion in the front-to-rear direction and is partly exposed upon the lower surface of the tongue portion. The shielding plate comprises a plate body and a plurality of hook portions protruding from the plate body. The plate body is held in the insulated housing and between the first flat contact portions and the second flat contact portions. The shielding plate is exposed upon two sides of the tongue portion. The at least one terminal organizer is fixedly assembled to the assembling region of the base portion. The at least one terminal organizer retains the second receptacle terminals. The at least one terminal organizer comprises a fixation block is used to retain each of the second body portions. A fixation portion is extended from one side of the fixation block for engaging with the engaging groove. The fixation portion fixes parts of each of the second flat contact portions, so that each of the second flat contact portions is fixed on the engaging groove of the tongue portion.

Based on the above, according to some embodiments of the instant disclosure, the terminal organizer extends the fixation portion attaching to the flat contact portions of the second receptacle terminals (i.e., second flat contact portions), so that the second flat contact portions are securely held on the tongue portion by the close abutment of the fixing portion. Therefore, when the terminal organizer is deformed due to heating and the second flat contact portions are not properly held in the terminal slots of the terminal organizer, the second flat contact portions can be still fixed on the tongue portion without being deflected upwardly. Furthermore, the recessed portions of the fixation portion allow the surface of the fixation portion between adjacent two second flat contact portions to be recessed, so that plastic materials would not overflow to the bottom surfaces of the flat contact portions. It is understood that, in the case that the plastic materials overflow to the bottom surfaces of the second flat contact portions, signals may not be transmitted efficiently when the plug terminals are in contact with the plastic materials.

In one embodiment, the fixation block comprises a step portion covering each of the second body portions, and the fixation portion is extending outwardly from one side of the step portion toward an end portion of each adjacent second flat contact portion.

In one embodiment, the fixation portion comprises a plurality of recessed grooves for receiving the second flat contact portions.

In one embodiment, the fixation portion comprises a plurality of spacing blocks respectively between each adjacent two recessed grooves, and each of the spacing blocks is abutted against a side surface of the corresponding second flat contact portion.

In one embodiment, each of the spacing blocks comprises a recessed portion, and each of the recessed portions is between each two adjacent second flat contact portions.

In one embodiment, two sides of the engaging groove respectively comprise two limiting grooves, and two sides of the fixation portion respectively comprise two protruding blocks for engaging with the limiting grooves.

Another embodiment of the instant disclosure provides an electrical receptacle connector. The electrical receptacle connector comprises a metallic shell, an insulated housing, a plurality of first receptacle terminals, a plurality of second receptacle terminals, a shielding plate, a first terminal organizer, and a second terminal organizer. The metallic shell comprises a receptacle cavity. The insulated housing is in the receptacle cavity. The insulated housing comprises a base portion and a tongue portion extending from one end of the base portion. The base portion has an assembling region, the tongue portion has an upper surface and a lower surface, the upper surface has a first engaging groove, and the lower surface has a second engaging groove. The first receptacle terminals comprise a plurality of first signal terminals, at least one first power terminal, and at least one first ground terminal. Each of the first receptacle terminals comprises a first flat contact portion and a first body portion, and the first flat contact portion extends forwardly from the first body portion in a front-to-rear direction and is partly exposed upon the upper surface of the tongue portion. The second receptacle terminals comprise a plurality of second signal terminals, at least one second power terminal, and at least one second ground terminal. Each of the second receptacle terminals comprises a second flat contact portion and a second body portion, and the second flat contact portion extends forwardly from the second body portion in the front-to-rear direction and is partly exposed upon the lower surface of the tongue portion. The shielding plate comprises a plate body and a plurality of hook portions protruding from the plate body. The plate body is held in the insulated housing and between the first flat contact portions and the second flat contact portions. The shielding plate is exposed upon two sides of the tongue portion. The first terminal organizer is fixedly assembled to the assembling region of the base portion. The first terminal organizer retains the first receptacle terminals. The first terminal organizer comprises a first fixation block which is used to retain each of the first body portions. A first fixation portion is extended outwardly from one side of the first fixation block for engaging with the first engaging groove. The first fixation portion is in contact with each of the first flat contact portions, so that each of the first flat contact portions is fixed on the upper surface of the tongue portion. The second terminal organizer is fixedly assembled to the assembling region of the base portion. The second terminal organizer retains the second receptacle terminals. The second terminal organizer comprises a second fixation block which is used to retain each of the second body portions. A second fixation portion is extended outwardly from one side of the second fixation block for engaging with the second engaging groove. The second fixation portion is in contact with each of the second flat contact portions, so that each of the second flat contact portions is fixed on the lower surface of the tongue portion.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
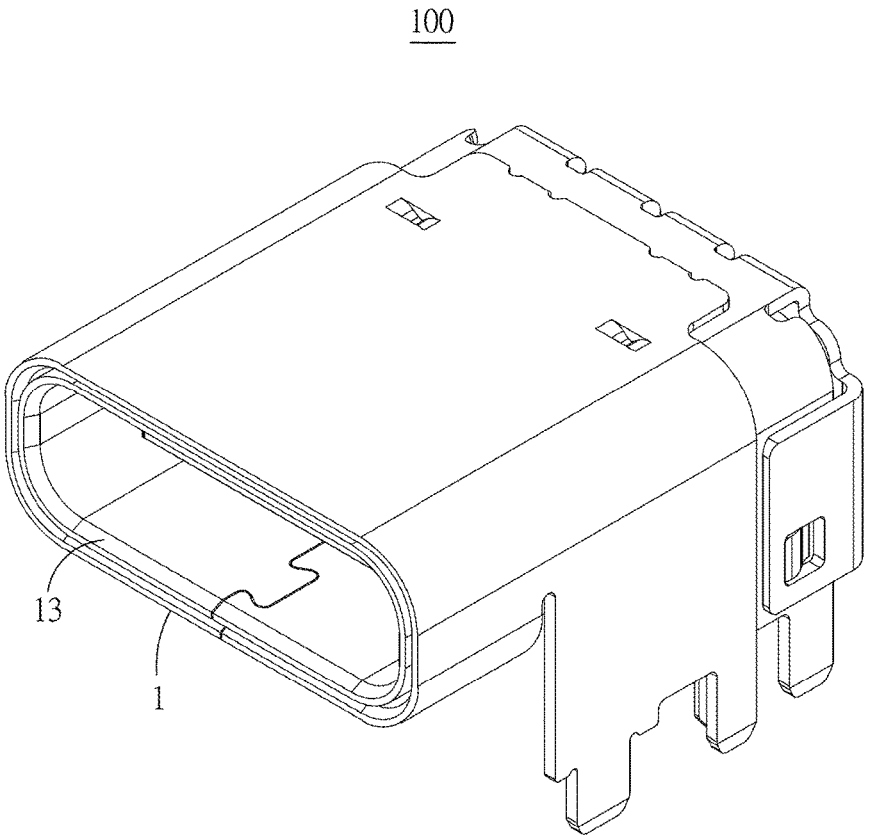
FIG. 1 illustrates a perspective view of an electrical receptacle connector according to a first embodiment of the instant disclosure.
Figure 2:
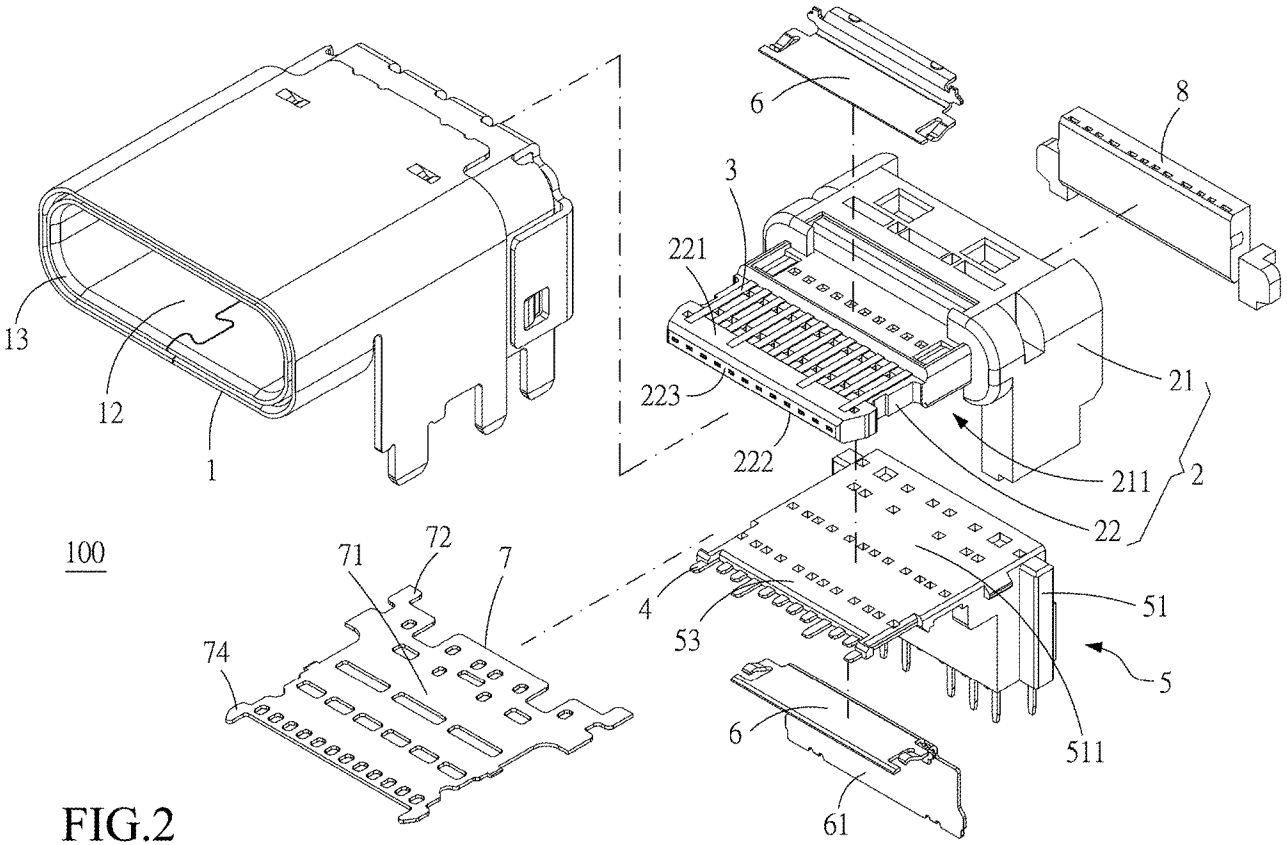
FIG. 2 illustrates an exploded view (1) of the electrical receptacle connector of the first embodiment.
Figure 3:
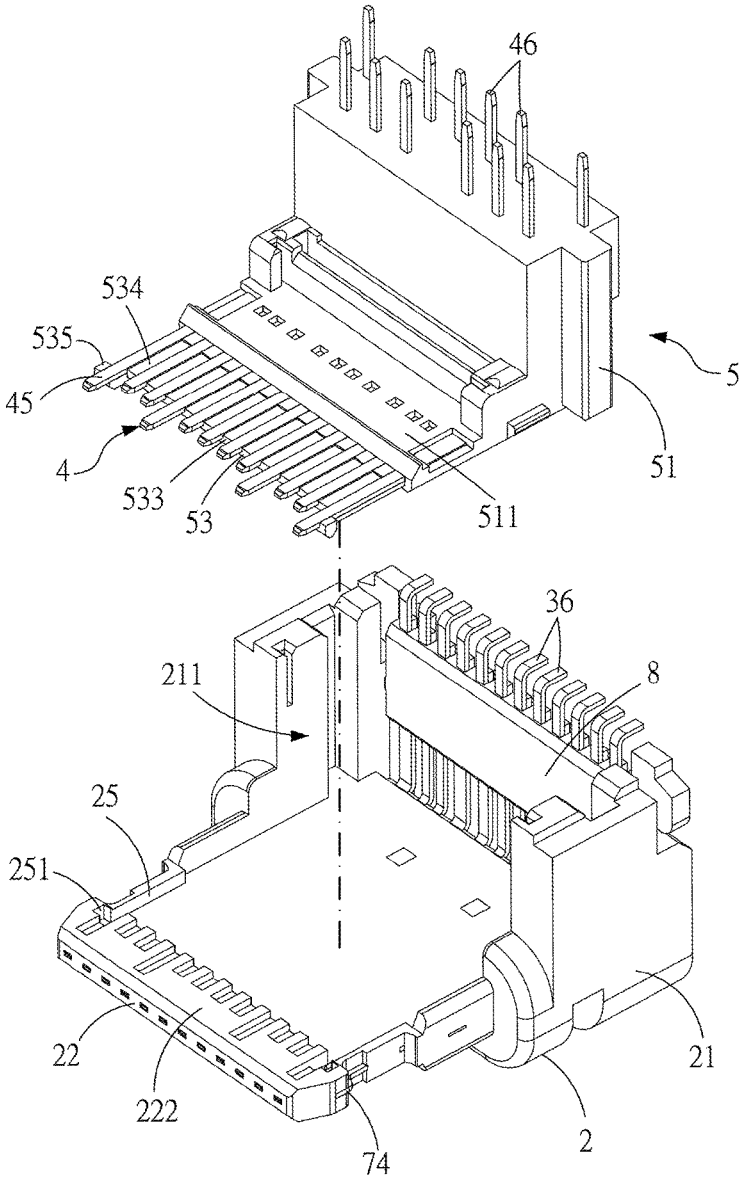
FIG. 3 illustrates an exploded view (2) of the electrical receptacle connector of the first embodiment.
Figure 4:
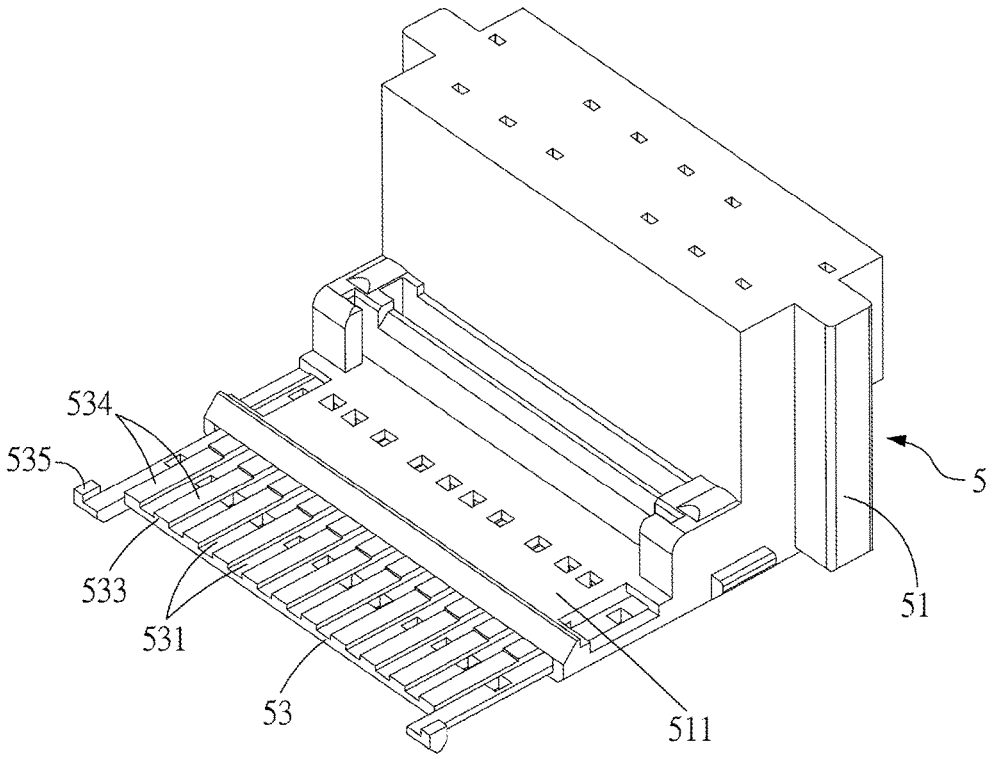
FIG. 4 illustrates a perspective view of a terminal organizer of the electrical receptacle connector of the first embodiment.
Figure 5:
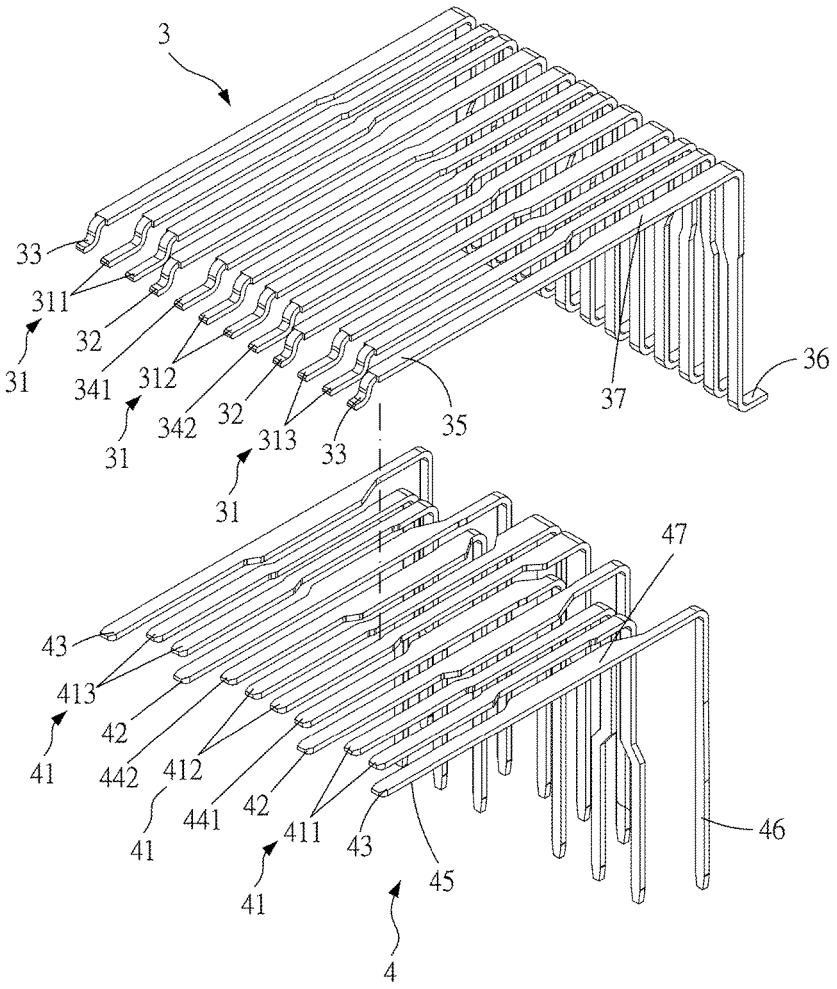
FIG. 5 illustrates a perspective view of first and second receptacle terminals of the electrical receptacle connector.

Please refer to FIGS. 1 to 3, illustrating an electrical receptacle connector according to a first embodiment of the instant disclosure. FIG. 1 illustrates a perspective view of an electrical receptacle connector of a first embodiment of the instant disclosure. FIG. 2 illustrates an exploded view (1) of the electrical receptacle connector of the first embodiment. FIG. 3 illustrates an exploded view (2) of the electrical receptacle connector of the first embodiment. The electrical receptacle connector 100 can provide a reversible or dual orientation USB Type-C connector interface and pin assignments, i.e., a USB Type-C receptacle connector. In this embodiment, the electrical receptacle connector 100 comprises a metallic shell 1, an insulated housing 2, a plurality of first receptacle terminals 3, a plurality of second receptacle terminals 4, a shielding plate 7, and at least one terminal organizer 5.

Please refer to FIGS. 1 and 2. The metallic shell 1 is a hollowed shell, and the metallic shell 1 has a receptacle cavity 12. In this embodiment, the metallic shell 1 may be, but not limited to, a multi-piece member; in some embodiments, the metallic shell 1 may be a unitary member.

Furthermore, one side of the metallic shell 1 has an insertion opening 13 in oblong shaped, and the insertion opening 13 is in communication with the receptacle cavity 12.

Please refer to FIGS. 2 and 3. The insulated housing 2 is received in the receptacle cavity 12 of the metallic shell 1. The insulated housing 2 comprises a base portion 21 and a tongue portion 22. In the first embodiment, the first receptacle terminals 3 and the shielding plate 7 are assembled with the insulated housing 2 by insert-molding techniques; in the second embodiment, the shielding plate 7 is assembled with the insulated housing 3 by insert-molding techniques. In addition, the tongue portion 22 extends from one end of the base portion 21, and the tongue portion 22 has an upper surface 221, a lower surface 222 opposite to the upper surface 221, and a front lateral surface 223. Moreover, in this embodiment, the base portion 21 has two side arms, and an assembling region 211 is located between the two side arms. At least one surface of the tongue portion 22 (in this embodiment, the lower surface 222) has an engaging groove 25; in other words, the lower surface 222 of the tongue portion 22 is recessed.

Please refer to FIGS. 2, 5, 7, and 8. In this embodiment, the first receptacle terminals 3 comprise a plurality of first signal terminals 31, a plurality of power terminals 32, and a plurality of ground terminals 33. From a front view of the first receptacle terminals 3, the first receptacle terminals 3 comprise, from left to right, a ground terminal 33 (Gnd), a first signal terminal pair 311 (TX1+−, differential signal terminals), a power terminal 32 (Power/VBUS), a first function detection terminal 341 (CC1, a terminal for inserting orientation detection of the connector and for cable recognition), a second signal terminal pair 312 (D+−, differential signal terminals), a first supplement terminal 342 (SBU1, a terminal reserved for other purposes), a power terminal 32 (Power/VBUS), a third signal terminal pair 313 (RX2+−, differential signal terminals), and a ground terminal 33 (Gnd). In this embodiment, twelve first receptacle terminals 3 are provided for transmitting USB 3.0 or USB 3.1 signals, but embodiments are not limited thereto. In one embodiment, the rightmost ground terminal 33 (Gnd) (or the leftmost ground terminal 33 (Gnd)) or the first supplement terminal 342 can be further omitted, and the total number of the first receptacle terminals 3 can be reduced from twelve terminals to seven terminals. Furthermore, the ground terminal 33 (Gnd) may be replaced by a power terminal 32 (Power/VBUS) and provided for power transmission. In this embodiment, the width of the power terminal 32 (Power/VBUS) may be greater than the width of the first signal terminal 31 and an electrical receptacle connector 100 having the power terminal 32 (Power/VBUS) can be provided for large current transmission.

Please refer to FIGS. 2, 5, 7, and 8. In this embodiment, the first receptacle terminals 3 are held in the base portion 21 and the tongue portion 22 to form upper-row receptacle terminals. Each of the first receptacle terminals 3 comprises a flat contact portion 35, a body portion 37, and a tail portion 36. For each of the first receptacle terminals 3, the body portion 37 is held in the base portion 21 and the tongue portion 22, the flat contact portion 35 extends forwardly from the body portion 37 in the rear-to-front direction and is partly exposed upon the upper surface 221 of the tongue portion 22, and the tail portion 36 extends backward from the body portion 37 in the front-to-rear direction and protrudes from the base portion 21. The first signal terminals 31 are disposed on the upper surface 221 and transmit first signals (namely, USB 3.0 or USB 3.1 signals). The tail portions 36 protrude from the bottom of the base portion 21 and are bent horizontally to form flat legs, named legs manufactured by SMT (surface mount technology), which can be mounted or soldered on the surface of a printed circuit board by using surface mount technology.

Please refer to FIGS. 2, 5, 7, and 8. In this embodiment, the second receptacle terminals 4 comprise a plurality of second signal terminals 41, a plurality of power terminals 42, and a plurality of ground terminals 43. From a front view of the second receptacle terminals 4, the second receptacle terminals 4 comprise, from right to left, a ground terminal 43 (Gnd), a first signal terminal pair 411 (TX1+−, differential signal terminals), a power terminal 42 (Power/VBUS), a first function detection terminal 441 (CC2, a terminal for inserting orientation detection of the connector and for cable recognition), a second signal terminal pair 412 (D+−, differential signal terminals), a second supplement terminal 442 (SBU2, a terminal reserved for other purposes), a power terminal 42 (Power/VBUS), a third signal terminal pair 413 (RX2+−, differential signal terminals), and a ground terminal 43 (Gnd). In this embodiment, twelve second receptacle terminals 4 are provided for transmitting USB 3.0 or USB 3.1 signals, but embodiments are not limited thereto. In one embodiment, the rightmost ground terminal 43 (Gnd) (or the leftmost ground terminal 43 (Gnd)) or the second supplement terminal 442 can be further omitted, and the total number of the second receptacle terminals 4 can be reduced from twelve terminals to seven terminals. Furthermore, the ground terminal 43 (Gnd) may be replaced by a power terminal 42 (Power/VBUS) and provided for power transmission. In this embodiment, the width of the power terminal 42 (Power/VBUS) may be greater than the width of the second signal terminal 41 and an electrical receptacle connector 100 having the power terminal 42 (Power/VBUS) can be provided for large current transmission.

Please refer to FIGS. 2, 5, 7, and 8. In this embodiment, the second receptacle terminals 4 are held in the base portion 21 and the tongue portion 22 to form lower-row receptacle terminals. Each of the second receptacle terminals 4 comprises a flat contact portion 45, a body portion 47, and a tail portion 46. For each of the second receptacle terminals 4, the body portion 47 is held in the base portion 21 and the tongue portion 22, the flat contact portion 45 extends forwardly from the body portion 47 in the rear-to-front direction and is partly exposed upon the lower surface 222 of the tongue portion 22, and the tail portion 46 extends backward from the body portion 47 in the front-to-rear direction. The second signal terminals 41 are disposed on the lower surface 221 and transmit second signals (namely, USB 3.0 or USB 3.1 signals). Moreover, the tail portions 46 may extend from the body portions 47 downwardly to form vertical legs, named legs manufactured by through-hole technology, which can be inserted into holes drilled in a printed circuit board (PCB). In some other embodiments, the tail portions 46 are bent horizontally to form flat legs, named legs manufactured by SMT (surface mount technology), which can be mounted or soldered on the surface of a printed circuit board by using surface mount technology.

Please refer to FIGS. 2, 5, 7, and 8. In this embodiment, the first receptacle terminals 3 and the second receptacle terminals 4 are disposed upon the upper surface 221 and the lower surface 222 of the tongue portion 22, respectively, and pin-assignments of the first receptacle terminals 3 and the second receptacle terminals 4 are point-symmetrical with a central point of the receptacle cavity 12 as the symmetrical center. In other words, pin-assignments of the first receptacle terminals 3 and the second receptacle terminals 4 have 180-degree symmetrical design with respect to the central point of the receptacle cavity 12 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 3 (or the second receptacle terminals 4), are rotated by 180 degrees with the symmetrical center as the rotating center, the first receptacle terminals 3 and the second receptacle terminals 4 are overlapped. That is, the rotated first receptacle terminals 3 are arranged at the position of the original second receptacle terminals 4, and the rotated second receptacle terminals 4 are arranged at the position of the original first receptacle terminals 3. In other words, the first receptacle terminals 3 and the second receptacle terminals 4 are arranged upside down, and the pin assignments of the flat contact portions 35 are left-right reversal with respect to that of the flat contact portions 45. An electrical plug connector is inserted into the electrical receptacle connector 100 with a first orientation where the upper surface 221 is facing up, for transmitting first signals. Conversely, the electrical plug connector is inserted into the electrical receptacle connector 100 with a second orientation where the upper surface 221 is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Additionally, in some embodiments, the electrical receptacle connector 100 is devoid of the first receptacle terminals 3 (or the second receptacle terminals 4) when an electrical plug connector to be mated with the electrical receptacle connector 100 has upper and lower plug terminals. In the case that the first receptacle terminals 3 are omitted, the upper plug terminals or the lower plug terminals of the electrical plug connector are in contact with the second receptacle terminals 4 of the electrical receptacle connector 100 when the electrical plug connector is inserted into the electrical receptacle connector 100 with the dual orientations. Conversely, in the case that the second receptacle terminals 4 are omitted, the upper plug terminals or the lower plug terminals of the electrical plug connector are in contact with the first receptacle terminals 3 of the electrical receptacle connector 100 when the electrical plug connector is inserted into the electrical receptacle connector 100 with the dual orientations. The inserting orientation of the electrical plug connector is not limited by the electrical receptacle connector 100 according embodiments of the instant disclosure.

Figure 6:
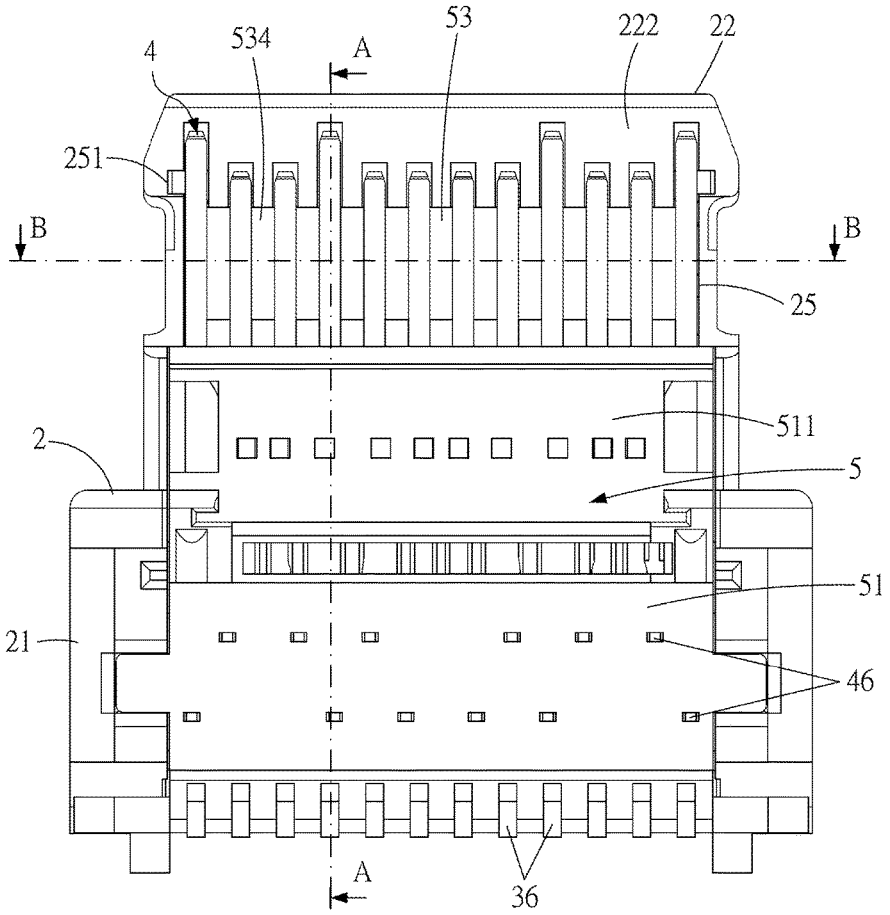
FIG. 6 illustrates a top view of the electrical receptacle connector of the first embodiment.
Figure 7:
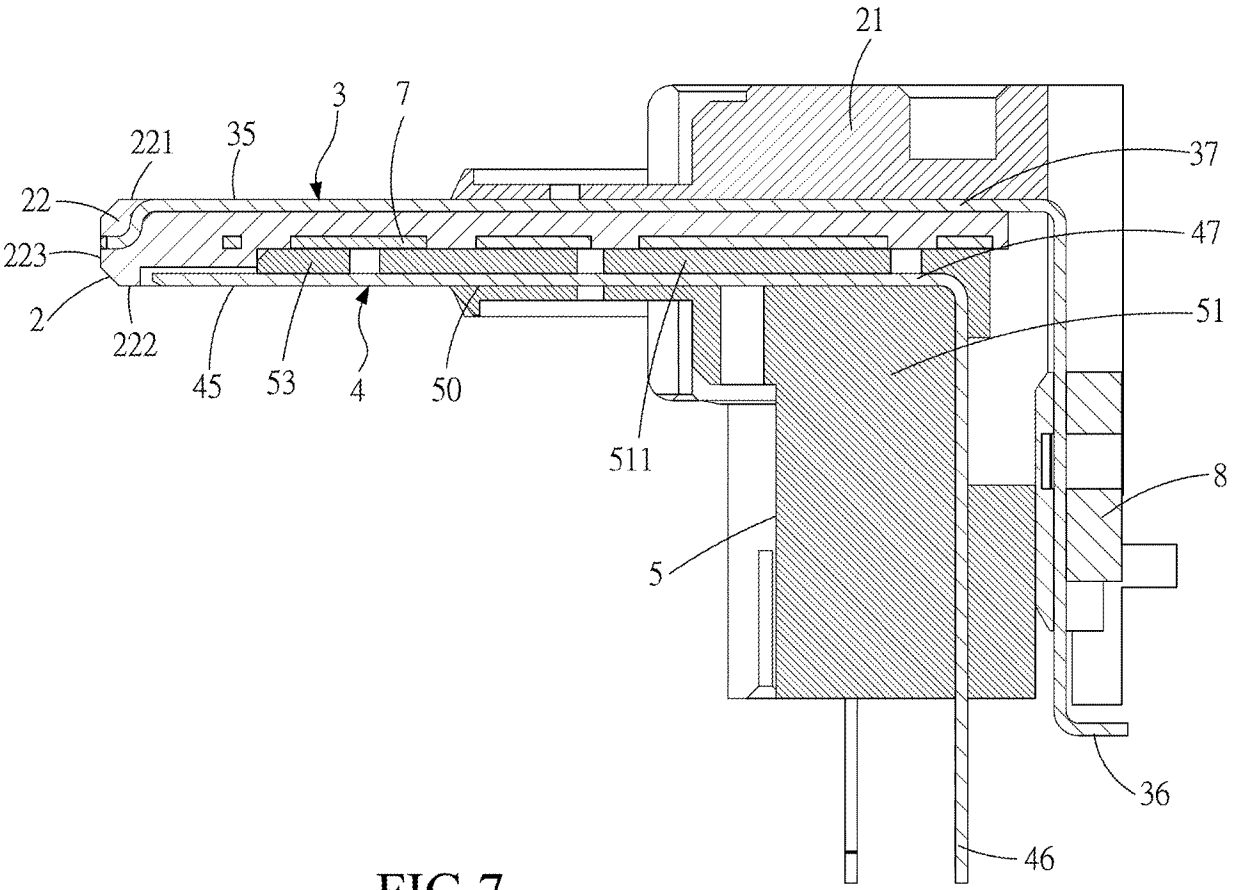
FIG. 7 illustrates a lateral sectional view along line 7-7 shown in FIG. 6.

Please refer to FIGS. 6 and 7. In this embodiment, the tail portions 36, 46 protrude from the base portion 21 and arranged separately. The tail portions 36, 46 may be arranged into two parallel rows. In some embodiments, the tail portions 46 may be aligned into two rows, and the first row of the tail portions 46 is aligned by an offset with respect to the second row of the tail portions 46. Thus, the tail portions 36, 46 form three rows.

Figure 8:
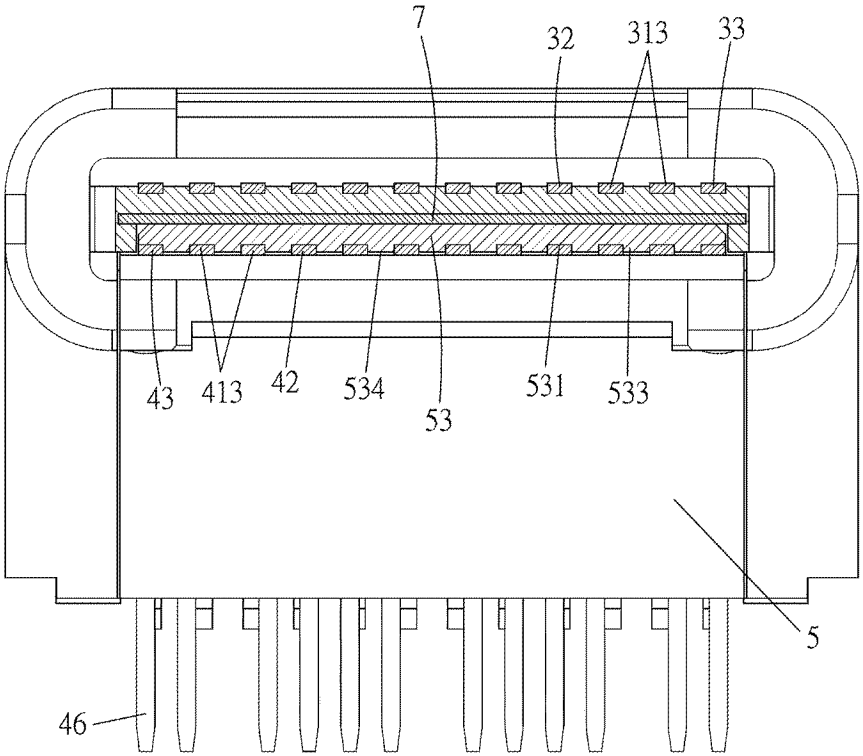
FIG. 8 illustrates a front sectional view along line 8-8 shown in FIG. 6.

Please refer to FIG. 8. In this embodiment, as viewed from the front of the receptacle terminals 3, 4, the position of the first receptacle terminals 3 corresponds to the position of the second receptacle terminals 4. In other words, the positions of the flat contact portions 35 are respectively aligned with the positions of the flat contact portions 45, but embodiments are not limited thereto. In some embodiments, the first receptacle terminals 3 may be aligned by an offset with respect to the second receptacle terminals 4. That is, the flat contact portions 35 are aligned by an offset with respect to the flat contact portions 45. Furthermore, the positions of the tail portion 36 may correspond to the positions of the tail portions 46. In some embodiments, the tail portions 36 may be aligned by an offset with respect to the tail portions 46. Accordingly, because of the offset alignment of the flat contact portions 35, 45, the crosstalk between the first receptacle terminals 3 and the second receptacle terminals 4 can be reduced during signal transmission. It is understood that, when the receptacle terminals 3, 4 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 3, 4 of the electrical receptacle connector 100 for power or signal transmission.

In the foregoing embodiments, the receptacle terminals 3, 4 are provided for transmitting USB 3.0 or USB 3.1 signals, but embodiments are not limited thereto. In some embodiments, for the first receptacle terminals 3 in accordance with transmission of USB 2.0 signals, the first signal terminal pair 311 (TX1+−) and the third signal terminal pair 313 (RX2+−) are omitted, and the second signal terminal pair 312 (D+−) and the power terminals 32 (Power/VBUS) are retained. While for the second receptacle terminals 4 in accordance with transmission of USB 2.0 signals, the first signal terminal pair 411 (TX2+−) and the third signal terminal pair 413 (RX1+−) are omitted, and the second signal terminal pair 412 (D+−) and the power terminals 42 (Power/VBUS) are retained.

Please refer to FIGS. 2 and 3. In this embodiment, the electrical receptacle connector 100 further comprises a pin positioning member 8. The pin positioning member 8 is a rectangular plate. The pin-positioning member 8 is formed with the tail portions 36, and two sides of the pin positioning member 8 are respectively engaged with the two side arms of the base portion 21.

Please refer to FIGS. 2 and 3. In this embodiment, the electrical receptacle connector 100 further comprises a shielding plate 7. The shielding plate 7 is held in the insulated housing 2. The shielding plate 7 comprises a plate body 71 and a plurality of legs 72. The plate body 71 is between the flat contact portions 35 of the first receptacle terminals 3 and the flat contact portions 45 of the second receptacle terminals 4. In other words, the plate body 71 is formed in the base portion 21 and the tongue portion 22 and located between the flat contact portions 35 of the first receptacle terminals 3 and the flat contact portions 45 of the second receptacle terminals 4. The legs 72 extend from two sides of the rear of the plate body 71, and the legs 72 protrude backwardly from the plate body 71 and may be, but not limited to, aligned horizontally. The legs 72 are exposed from the rear of the base portion 21 and in contact with the metallic shell 1 or a circuit board. The crosstalk interference can be reduced by the shielding of the shielding plate 7 when the flat contact portions 35, 45 transmit signals. Furthermore, the structural strength of the tongue portion 22 can be improved by the assembly of the shielding plate 7. Moreover, the legs 72 may be located at two sides of the plate body 71 and extend downwardly to form vertical pins (that is, pins manufactured by through-hole technology), the legs 72 are exposed from two sides of the base portion 21 and in contact with the circuit board. Further, outer lateral surfaces of the legs 72 are in contact with an inner wall of the metallic shell 1 by laser welding techniques.

Please refer to FIGS. 2 and 3. In this embodiment, the shielding plate 7 further comprises a plurality of hooks 74. The hooks 74 are protruding or exposed from two sides of the tongue portion 22. When an electrical plug connector is mated with the electrical receptacle connector 100, elastic pieces at two sides of an insulated housing of the electrical plug connector are engaged with or in contact with the hooks 73, and the elastic pieces would not wear against the tongue portion 221 of the electrical receptacle connector 100. Hence, the sheilding plate 7 can be in contact with the metallic shell 11 for conduction and grounding.

Please refer to FIGS. 2, 3, 4, 7, and 8. In this embodiment, the electrical receptacle connector 100 comprises at least one terminal organizer 5. The terminal organizer 5 is formed with the second receptacle terminals 4 and assembled with the second receptacle terminals 4. The terminal organizer 5 is fixedly assembled to the assembling region 211 of the base portion 21. Two sides of the terminal organizer 5 are respectively engaged with the two side arms of the base portion 21.

Please refer to FIGS. 2, 3, 4, 7, and 8. In this embodiment, the terminal organizer 5 comprises a fixation block 51 which is used to retain each of the body portions 47. The fixation block 51 is an L-shaped block. A fixation portion 53 extends outwardly from one side of the fixation block 51 to form the L-shaped block and the fixation portion 53 is for engaging with the engaging groove 25. The fixation portion 53 is attached to the flat contact portions 45. The fixation portion 53 is in contact with the flat contact portions 45, so that the fixation portion 53 fixes the flat contact portions 45 on the lower surface 222 of the tongue portion 22. In this embodiment, the fixation block 51 comprises a step portion 511 covering each of the body portions 47, and the fixation portion 53 is extending outwardly from one side of the step portion 511 toward an end portion 45*a* of each adjacent flat contact portions 45. In this embodiment, the end portion 45*a* of each of the flat contact portions 45 protrudes from an edge portion of the fixation portion 53, and the end portion 45*a* of each of the flat contact portions 45 is respectively received in the corresponding recess formed on the lower surface 222 of the tongue portion 22.

Please refer to FIGS. 2, 3, 4, 7, and 8. In this embodiment, the fixation portion 53 comprises a plurality of recessed grooves 531 for receiving the flat contact portions 45. In other words, two sides and a top surface of each of the flat contact portions 45 are in contact with inner side surfaces of the corresponding recessed groove 531 (while bottom surfaces of the flat contact portions 45 are to be in contact with plug terminals of an electrical plug connector). Hence, the flat contact portions 45 can be properly fixed with the fixation portion 53. Therefore, when the terminal organizer 5 and the flat contact portions 45 are heated, even if terminal slots 50 of the terminal organizer 5 are deformed and the flat contact portions 45 are not firmly held in the terminal slots 50 and would have displacements the flat contact portions 45 do not deflect upwardly from the tongue portion 22 due to the fixation of the fixation portion 53. Specifically, it is understood that, during the manufacturing process of the electrical receptacle connector 100 soldered with a circuit board in a convention flow oven, contact portions between the terminal organizer 5 and the second receptacle terminals 4, i.e., the terminal slots 50 in the terminal organizer 5, would be deformed in such high temperature process, so that the size of the terminal slots 50 would increase and inner surfaces of the terminal slots 50 are not firmly attached with the second receptacle terminals 4. Nevertheless, because of the fixation between the fixation portion 53 and the flat contact portions 45, the flat contact portions 45 of the second receptacle terminals 4 are not deflected upwardly from the tongue portion 22 easily.

Please refer to FIGS. 2, 3, 4, 7, and 8. In this embodiment, the fixation portion 53 comprises a plurality of spacing blocks 533 respectively between each adjacent two recessed grooves 531. Each of the spacing blocks 533 is abutted against a side surface 45*b* of the corresponding flat contact portion 45. In this embodiment, the fixation portion 53 comprises the recessed grooves 531, but embodiments are not limited to. In one another embodiment, the fixation portion 53 may comprise a plurality of rib structures attached on the top surfaces of the flat contact portions 45; that is, in the embodiment, the fixation portion 53 may comprise the spacing blocks 533 (i.e., the rib structures) and does not have the recessed grooves 531. The rib structures are separated from each other. In such embodiment, the deflection problem of the flat contact portions 45 can also be prevented. In other words, with the rib structures attached on the top surfaces of the flat contact portions 45 (while the bottom surfaces of the flat contact portions 45 are to be in contact with plug terminals of an electrical plug connector), when the terminal organizer 5 is deformed during a high temperature process, the fixation portion 53 can still fix and support the flat contact portions 45, so that the flat contact portions 45 can be securely fixed on the lower surface 222 of the tongue portion 22.

Please refer to FIGS. 2, 3, 4, 7, and 8. In this embodiment, each of the spacing blocks 533 comprises a recessed portion 534, and each of the recessed portions 534 is between each two adjacent flat contact portions 45. In other words, the lower surface of each of the spacing blocks 533 is recessed to form the recessed portion 534, and the lower surface of the spacing block 533 and the bottom surface of the flat contact portion 45 are aligned in different horizontal planes. Therefore, during the forming process of the connector, the recessed portions 534 prevent plastic materials from being overflowing to the bottom surfaces of the flat contact portions 45. It is understood that, in the case that the plastic materials overflow to the bottom surfaces of the flat contact portions 45, signals may not be transmitted efficiently when the plug terminals are in contact with the plastic materials.

Please refer to FIGS. 2, 3, 4, 7, and 8. In this embodiment, two sides of the engaging groove 25 of the tongue portion 22 respectively comprise two limiting grooves 251, and two sides of the fixation portion 53 respectively comprise two protruding blocks 535 for engaging with the limiting grooves 251.

Please refer to FIG. 2. In this embodiment, the electrical receptacle connector 100 may further comprise a plurality of conductive sheets 6 and a shielding sheet 61. The conductive sheets 6 are metal elongated plates and may comprise an upper conductive sheet 6 and a lower conductive sheet 6. The upper conductive sheet 6 is assembled on the tongue portion 22 of the insulated housing 2. The lower conductive sheet 6 is assembled on the step portion 511 of the terminal organizer 5. The shielding sheet 61 extends outwardly and downwardly from the lower conductive sheet 6, and the shielding sheet 61 covers a front lateral surface of the terminal organizer 5.

When an electrical plug connector is mated with the electrical receptacle connector 100, the front of a metallic shell of the electrical plug connector is in contact with the conductive sheets 6, so that the metallic shell of the electrical plug connector is efficiently in contact with the metallic shell 1 of the electrical receptacle connector 100 via the conductive sheets 6, and the electromagnetic interference (EMI) problem can be improved. The shielding sheet 61 covers the front lateral surface of the terminal organizer 5, so that the shielding sheet 61 can retard the high frequency features of the tail portions 46 inside the terminal organizer 5.

Figure 9:
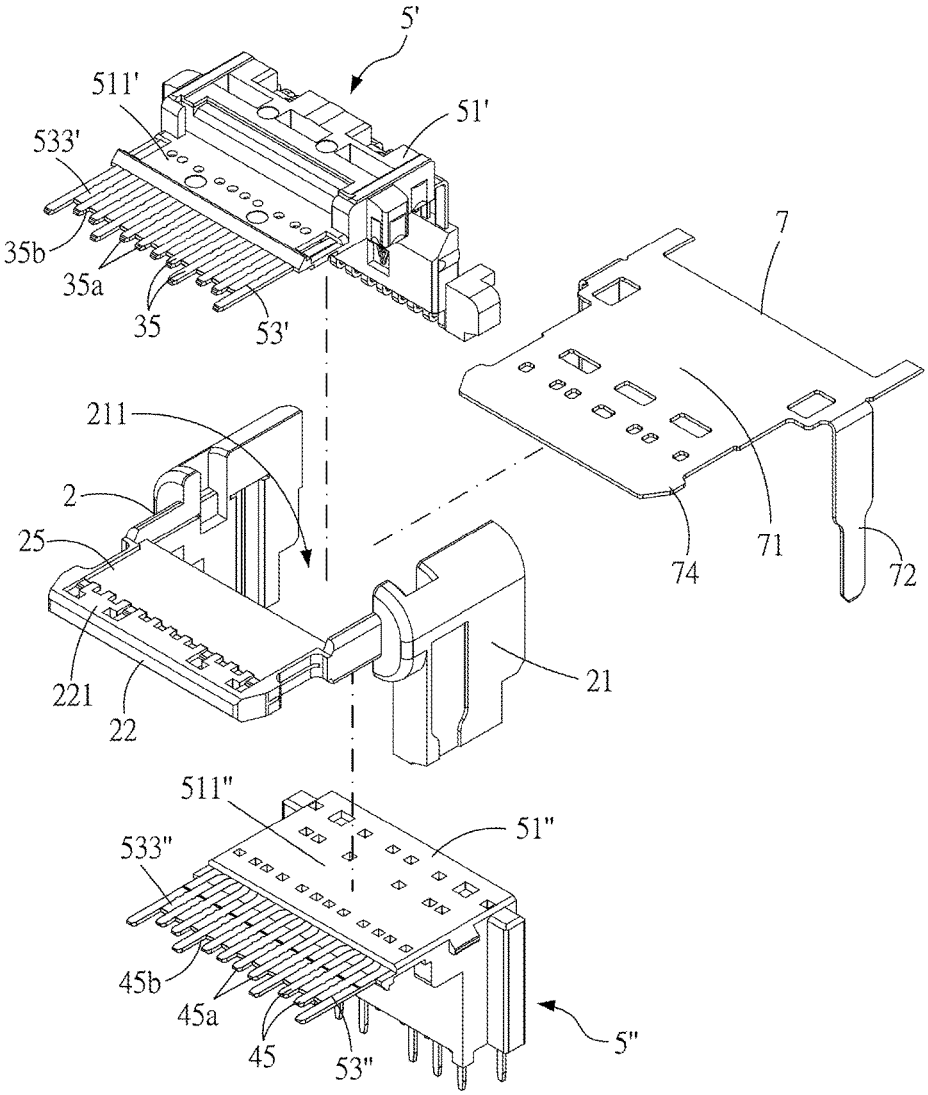
FIG. 9 illustrates an exploded view of an electrical receptacle connector according to a second embodiment of the instant disclosure.
Figure 10:
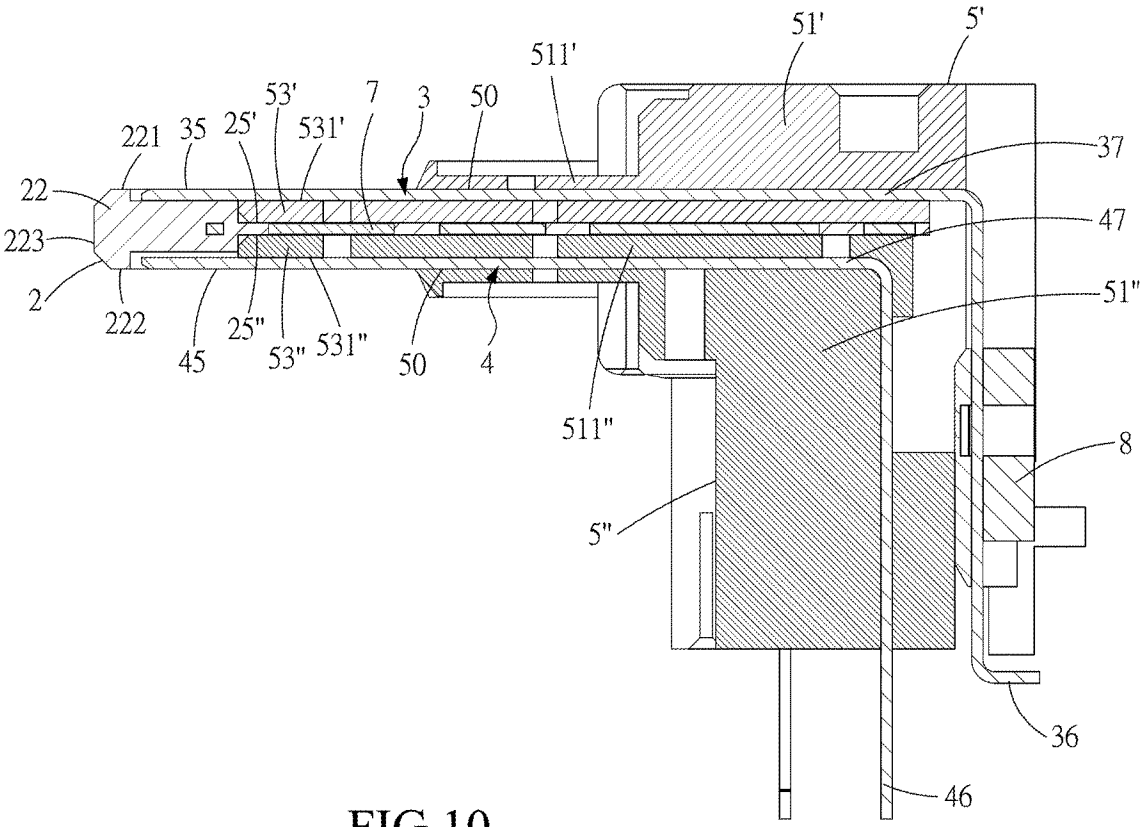
FIG. 10 illustrates a lateral sectional view of the electrical receptacle connector of the second embodiment.

Please refer to FIGS. 9 and 10, illustrating an electrical receptacle connector 100 according to a second embodiment of the instant disclosure. In the first embodiment, the insulated housing 2 is a two-piece member and is assembled with the terminal organizer 5; while in the second embodiment, the insulated housing 2 is a three-piece member and is assembled with a first terminal organizer 5' and a second terminal organizer 5".

Please refer to FIGS. 9 and 10. In this embodiment, the tongue portion 22 has an upper surface 221 and a lower surface 222 opposite to the upper surface 221, the upper surface 221 of the tongue portion 22 has a first engaging groove 25', and the lower surface 222 of the tongue portion 22 has a second engaging groove 25". The first terminal organizer 5' is fixedly assembled to the assembling region 211 of the base portion 21, and the first terminal organizer 5' retains the first receptacle terminals 3. The first terminal organizer 5' comprises a first fixation block 51' which is used to retain each of the body portions 37. A first fixation portion 53' is extended outwardly from one side of the first fixation block 51' for engaging with the first engaging groove 25'. The first fixation portion 53' is in contact with each of the flat contact portions 35, so that each of the flat contact portions 35 is fixed on the upper surface 221 of the tongue portion 22.

Please refer to FIGS. 9 and 10. In this embodiment, the second terminal organizer 5" is fixedly assembled to the assembling region 211 of the base portion 21, and the second terminal organizer 5" retains the second receptacle terminals 4. The second terminal organizer 5" comprises a second fixation block 51" which is used to retain each of the body portions 47. A second fixation portion 53" is extended outwardly from the second fixation block 51" for engaging with the second engaging grooves 25". The second fixation portion 53" is in contact with each of the flat contact portions 45, so that each of the flat contact portions 45 is fixed on the lower surface 222 of the tongue portion 22.

Please refer to FIGS. 9 and 10. In this embodiment, the first fixation block 51' comprises a first step portion 511' covering each of the body portions 37, and the second fixation block 51" comprises a second step portion 511" covering each of the body portions 47. The first fixation portion 53' is extending outwardly from one side of the first step portion 511' toward an end portion 35*a* of each adjacent flat contact portion 35, and the second fixation portion 53" is extending outwardly from one side of the second step portion 511" toward an end portion 45*a* of each adjacent flat contact portion 45.

Please refer to FIGS. 9 and 10. In this embodiment, the first fixation portion 53' comprises a plurality of first recessed grooves 531' for receiving the flat contact portions 35, and the second fixation portion 53" comprises a plurality of second recessed grooves 531" for receiving the flat contact portions 45.

Please refer to FIGS. 9 and 10. In this embodiment, the first fixation portion 53' comprises a plurality of first spacing blocks 533' respectively between each adjacent two first recessed grooves 531', and each of the first spacing blocks 533' is abutted against a side surface 35*b* of the corresponding flat contact portion 35. The second fixation portion 53" comprises a plurality of second spacing blocks 533" respectively between each adjacent two second recessed groove 531", and each of the second spacing blocks 533" is abutted against a side surface 45*b* of the corresponding flat contact portion 45.

Based on the above, according to some embodiments of the instant disclosure, the terminal organizer extends the fixation portion attaching to the flat contact portions of the second receptacle terminals (i.e., second flat contact portions), so that the second flat contact portions are securely held on the tongue portion by the close abutment of the fixing portion. Therefore, when the terminal organizer is deformed due to heating and the second flat contact portions are not properly held in the terminal slots of the terminal organizer, the second flat contact portions can be still fixed on the tongue portion without being deflected upwardly. Furthermore, the recessed portions of the fixation portion allow the surface of the fixation portion between adjacent two second flat contact portions to be recessed, so that plastic materials would not overflow to the bottom surfaces of the flat contact portions. It is understood that, in the case that the plastic materials overflow to the bottom surfaces of the second flat contact portions, signals may not be transmitted efficiently when the plug terminals are in contact with the plastic materials.

What is claimed is:

1. An electrical receptacle connector, comprising:

a metallic shell comprising a receptacle cavity;

an insulated housing in the receptacle cavity, wherein the insulated housing comprises a base portion and a tongue portion extending from one end of the base portion, the base portion has an assembling region, wherein the tongue portion has an upper surface and a lower surface, and the lower surface of the tongue portion has an engaging groove;

a plurality of first receptacle terminals held in the base portion and the tongue portion, wherein each of the first receptacle terminals comprises a first flat contact portion and a first body portion, the first body portion is held in the base portion and the tongue portion, the first flat contact portion extends forwardly from the first body portion in a front-to-rear direction and is partly exposed upon the upper surface of the tongue portion;

a plurality of second receptacle terminals each comprising a second flat contact portion and a second body portion, wherein the second flat contact portion extends forwardly from the second body portion in the front-to-rear direction and is partly exposed upon the lower surface of the tongue portion;

a shielding plate held in the insulated housing and between the first flat contact portions and the second flat contact portions; and a terminal organizer fixedly assembled to the assembling region of the base portion, wherein the at least one terminal organizer retains the second receptacle terminals, the terminal organizer comprises a fixation block and a fixation portion retaining the second body portions, the fixation portion is extended outwardly from one side of the fixation block for engaging with the engaging groove, the fixation portion fixes parts of each of the second flat contact portions, so that each of the second flat contact portions is fixed on the engaging groove of the tongue portion, and the fixation portion comprises a plurality of recessed grooves for receiving the second flat contact portions.

2. The electrical receptacle connector according to claim 1, wherein the fixation block comprises a step portion covering each of the second body portions, the fixation portion is extending outwardly from one side of the step portion toward an end portion of each adjacent second flat contact portion.

3. The electrical receptacle connector according to claim 1, wherein the fixation portion comprises a plurality of spacing blocks respectively between each adjacent two recessed grooves, each of the spacing blocks is abutted against a side surface of the corresponding second flat contact portion.

4. The electrical receptacle connector according to claim 3, wherein each of the spacing blocks comprises a recessed portion, each of the recessed portions is between each two adjacent second flat contact portions.

5. An electrical receptacle connector, comprising:

a metallic shell comprising a receptacle cavity;

an insulated housing in the receptacle cavity, wherein the insulated housing comprises a base portion and a tongue portion extending from one end of the base portion, the base portion has an assembling region, wherein the tongue portion has an upper surface and a lower surface, and the lower surface of the tongue portion has an engaging groove, and two sides of the engaging groove respectively comprise two limiting grooves;

a plurality of first receptacle terminals held in the base portion and the tongue portion, wherein each of the first receptacle terminals comprises a first flat contact portion and a first body portion, the first body portion is held in the base portion and the tongue portion, the first flat contact portion extends forwardly from the first body portion in a front-to-rear direction and is partly exposed upon the upper surface of the tongue portion;

a plurality of second receptacle terminals, each of the second receptacle terminals comprising a second flat contact portion and a second body portion, wherein the second flat contact portion extends forwardly from the second body portion in the front-to-rear direction and is partly exposed upon the lower surface of the tongue portion;

a shielding plate held in the insulated housing and between the first flat contact portions and the second flat contact portions; and a terminal organizer fixedly assembled to the assembling region of the base portion, wherein the at least one terminal organizer retains the second receptacle terminals, the terminal organizer comprises a fixation block and a fixation portion retaining the second body portions, the fixation portion is extended outwardly from one side of the fixation block for engaging with the engaging groove, the fixation portion fixes parts of each of the second flat contact portions, so that each of the second flat contact portions is fixed on the engaging groove of the tongue portion, and two sides of the fixation portion respectively comprise two protruding blocks for engaging with the limiting grooves.

6. The electrical receptacle connector according to claim 1, further comprising a plurality of conductive sheets, each of the conductive sheets is on the insulated housing and the step portion of the at least one terminal organizer.

7. An electrical receptacle connector, comprising:

a metallic shell comprising a receptacle cavity;

an insulated housing in the receptacle cavity, wherein the insulated housing comprises a base portion and a tongue portion extending from one end of the base portion, the base portion has an assembling region, the tongue portion has an upper surface and a lower surface, the upper surface of the tongue portion has a first engaging groove, the lower surface of the tongue portion has a second engaging groove;

a plurality of first receptacle terminals, wherein each of the first receptacle terminals comprises a first flat contact portion and a first body portion and the first flat contact portion extends forwardly from the first body portion in a front-to-rear direction and is partly exposed upon the upper surface of the tongue portion;

a plurality of second receptacle terminals, wherein each of the second receptacle terminals comprises a second flat contact portion and a second body portion and the second flat contact portion extends forwardly from the second body portion in the front-to-rear direction and is partly exposed upon the lower surface of the tongue portion;

a shielding plate comprising held in the insulated housing and between the first flat contact portions and the second flat contact portions;

a first terminal organizer fixedly assembled to the assembling region of the base portion, wherein the first terminal organizer retains the first receptacle terminals, the first terminal organizer comprises a first fixation block retaining the first body portions, and a first fixation portion is extended outwardly from one side of the first fixation block for engaging with the first engaging groove, the first fixation portion is in contact with each of the first flat contact portions, so that each of the first flat contact portions is fixed on the upper surface of the tongue portion; and a second terminal organizer fixedly assembled to the assembling region of the base portion, wherein the second terminal organizer retains the second receptacle terminals, the second terminal organizer comprises a second fixation block retaining the second body portions, a second fixation portion is extended outwardly from one side of the second fixation block for engaging with the second flat contact portions, the second fixation portion is in contact with each of the second flat contact portions, so that each of the second flat contact portions is fixed on the lower surface of the tongue portion.

8. The electrical receptacle connector according to claim 7, wherein the first fixation block comprises a first step portion covering each of the first body portions, the second fixation block comprises a second step portion covering each of the second body portions, the first fixation portion is extending outwardly from one side of the first step portion toward an end portion of each adjacent first flat contact portion, the second fixation portion is extending outwardly from one side of the second step portion toward an end portion of each adjacent second flat contact portion.

9. The electrical receptacle connector according to claim 8, wherein the first fixation portion comprises a plurality of first recessed grooves for receiving the first flat contact portions, the second fixation portion comprises a plurality of second recessed grooves for receiving the second flat contact portions.

10. The electrical receptacle connector according to claim 9, wherein the first fixation portion comprises a plurality of first spacing blocks respectively between each adjacent two first recessed grooves, each of the first spacing blocks is abutted against a side surface of the corresponding first flat contact portion, the second fixation portion comprises a plurality of second spacing blocks respectively between each adjacent two second recessed grooves, each of the second spacing blocks is abutted against a side surface of the corresponding second flat contact portion.

11. The electrical receptacle connector according to claim 1, wherein the shielding plate comprises a plate body and two hook portions respectively protruding from two sides of the plate body, wherein two sides of the shielding plate are exposed upon two sides of the tongue portion.

12. The electrical receptacle connector according to claim 5, wherein the shielding plate comprises a plate body and two hook portions respectively protruding from two sides of the plate body, wherein two sides of the shielding plate are exposed upon two sides of the tongue portion.

13. The electrical receptacle connector according to claim 7, wherein the shielding plate comprises a plate body and two hook portions respectively protruding from two sides of the plate body, wherein two sides of the shielding plate are exposed upon two sides of the tongue portion.

14. The electrical receptacle connector according to claim 7, wherein the plurality of first receptacle terminals comprises a plurality of first signal terminals, at least one first power terminal, and at least one first ground terminal and the plurality of second receptacle terminals comprise a plurality of second signal terminals, at least one second power terminal, and at least one second ground terminal.

* * * * *